US005520842A

United States Patent [19]

Ponce et al.

[11] Patent Number: 5,520,842

[45] Date of Patent: May 28, 1996

[54] SOLID DETERGENT COMPOSITIONS COMPRISING AT LEAST ONE STORAGE-STABLE, BIODEGRADABLE AND NON-HYGROSCOPIC DERIVATIVE OF A POLYCARBOXYLIC POLYMER

[75] Inventors: Arnaud Ponce, Aubervilliers; Florence Tournilhac, Paris, both of France

[73] Assignee: Rhone Poulenc Chimie, Courbevoie, Cedex, France

[21] Appl. No.: 187,063

[22] Filed: Jan. 27, 1994

[30] Foreign Application Priority Data

Jan. 27, 1993 [FR] France ..... 93 00776

[51] Int. Cl.[6] ..... C11D 3/37; C11D 3/33; C11D 17/00; C11D 17/06

[52] U.S. Cl. ..... 252/174.24; 252/94; 252/173; 252/174; 252/174.14; 252/174.19; 252/174.25; 252/525; 252/527; 252/544; 252/546; 252/DIG. 2; 252/DIG. 11

[58] Field of Search ..... 252/174.23, DIG. 2, 252/174.24, 546, 544, 527, 525, DIG. 11

[56] References Cited

U.S. PATENT DOCUMENTS

| | | | |
|---|---|---|---|
| 3,474,083 | 10/1969 | Shiga et al. | 252/8.8 |
| 3,846,380 | 11/1974 | Fujimoto et al. | 252/357 |
| 4,242,215 | 12/1980 | Smid et al. | 252/100 |
| 4,622,173 | 11/1986 | Broze et al. | 252/528 |
| 4,749,512 | 6/1988 | Broze et al. | 252/174.18 |
| 4,783,282 | 11/1988 | Smid | 252/546 |
| 4,839,461 | 6/1989 | Boehmke | 252/175 |
| 5,116,513 | 5/1992 | Koskan et al. | 252/180 |
| 5,152,902 | 10/1992 | Koskan et al. | 252/180 |
| 5,284,512 | 2/1994 | Koskan et al. | 252/357 |
| 5,306,429 | 4/1994 | Wood et al. | 252/180 |
| 5,328,631 | 7/1994 | Du Vosel et al. | 252/174.23 |
| 5,328,690 | 7/1994 | Sikes | 424/401 |

FOREIGN PATENT DOCUMENTS

| | | |
|---|---|---|
| 0454126A1 | 10/1991 | European Pat. Off. . |
| 0511037A1 | 10/1992 | European Pat. Off. . |
| 0561452 | 9/1993 | European Pat. Off. . |

OTHER PUBLICATIONS

Hawley's Condensed Chemical Dictionary, 12th ed. (1993), p. 1075 (no month available).

Search Report for FR 9300776, Oct. 22, 1993.

*Primary Examiner*—Paul Lieberman
*Assistant Examiner*—Ardith Hertzog
*Attorney, Agent, or Firm*—Burns, Doane, Swecker & Mathis

[57] ABSTRACT

Improvedly storage-stable, solid, particulate detergent compositions include a detergency surfactant and a builder therefor, the builder comprising at least one storage-stable, substantially non-hygroscopic, at least partially water-insoluble biodegradable polycarboxylic polymer compatible therewith, for example at least partially comprising a water-insoluble inorganic salt thereof, e.g., a calcium or magnesium salt, or at least partially comprising a water-soluble/water-insoluble mixed salt thereof, e.g., a Na/Ca mixed salt.

8 Claims, No Drawings

SOLID DETERGENT COMPOSITIONS COMPRISING AT LEAST ONE STORAGE-STABLE, BIODEGRADABLE AND NON-HYGROSCOPIC DERIVATIVE OF A POLYCARBOXYLIC POLYMER

BACKGROUND OF THE INVENTION

1. Field of the Invention

The present invention relates to solid detergent compositions comprising at least one biodegradable polycarboxylic polymer in a water-insoluble form, compatible with prolonged storage thereof.

2. Description of the Prior Art

Typical detergent compositions incorporate many reagents, each of which being responsible for a clearly specific function. Among these conventional reagents, particularly significant is the detergent builder.

By "builder" is intended any constituent which improves or enhances the performance of the surface-active agents, or surfactants, of a detergent composition. In general, a builder serves many functions:

(a) it ensures, in a washing medium, the removal of the undesirable ions, especially alkaline earth metal (calcium, magnesium) ions, by sequestration, complexation or precipitation in order to prevent the precipitation of the anionic surfactants.

(b) it provides a reserve of alkalinity and ionic strength, (c) it maintains the dirt extracted in suspension, and (d) it prevents inorganic incrustation of the washing.

Tripolyphosphates have long been the builders most conventionally incorporated in detergent compositions and washing products. Nevertheless, these are partly responsible for eutrophication of lakes and waters flowing slowly, when they are not sufficiently removed by water treatment plants. Consequently, efforts have been expended to replace the tripolyphosphates, whether partially or totally.

Zeolites alone cannot replace the tripolyphosphates, their efficacy has to be reinforced by other additives.

Copolymers of acrylic acid and maleic anhydride (or their alkali metal or ammonium salts) have been described (European Patent No. 25,551) as inhibitors of incrustation.

However, these acrylic acid and maleic anhydride copolymers, as well as the zeolites, are not subject to biodegradation in the natural environment.

With the objective to satisfy recent ecological requirements, peptide polymers of the amino acid polymer or copolymer type have also been described as builders.

In particular, sodium polyaspartates and polyglutamates, which are of interest because of their total biodegradability, exhibit good builder activity (U.S. Pat. No. 4,428,749). It has been demonstrated that it is the negatively charged form of these compounds which is the active species in the builder function.

Unfortunately, the water-soluble salts of these peptide polymers are unsuited for prolonged storage in solid detergent formulations. Rapidly, they tend to become hydrolyzed and then to become degraded upon contact with oxidizing and basic agents which are also present in the washing formula. After one month of storage, these compounds are incapable of serving a builder function.

SUMMARY OF THE INVENTION

Accordingly, a major object of the present invention is the provision of improved detergent compositions comprising particular polycarboxylic polymer builders, whereby the chemical and storage-stability, biodegradability, and "builder" efficacy thereof, are preserved.

Another object of this invention is the provision of improved detergent compositions which otherwise avoid or conspicuously ameliorate the above disadvantages and drawbacks to date characterizing the state of this art, and which serve to establish a compromise between the chemical stability of the builder and its conversion, in the washing bath, into the active species thereof, i.e., into its negatively charged form. Thus, such chemical stability is not acquired at the expense of the subsequent generation of the active species.

Briefly, the present invention features solid, particulate detergent compositions comprising at least one biodegradable polycarboxylic polymer, said polymer being present therein either, (a) partially or completely, in the form of one of the water-insoluble inorganic salts thereof, or (b) in the form of a water-soluble/water-insoluble mixed salt thereof, and said corresponding polycarboxylic polymer being substantially non-hygroscopic and compatible with prolonged storage when formulated into the detergent formulation.

DETAILED DESCRIPTION OF BEST MODE AND PREFERRED EMBODIMENTS OF THE INVENTION

More particularly according to the present invention, the polycarboxylic polymer has a molar ratio water-insoluble salt/water-soluble functional groups and/or a steric arrangement water-insoluble salt/water-soluble functional groups such that it is substantially non-hygroscopic, rendering it compatible with prolonged storage in a detergent formulation.

By "water-soluble functional group" is intended a hydrolyzable functional group which has not been salified by a water-insoluble inorganic salt. For example, in the case of a carboxylic functional group, the water-soluble functional group comprehends the acidic form and the form salified with a water-soluble salt.

By "water-insoluble salt" is intended a hydrolyzable functional group salified by a water-insoluble inorganic salt.

By "detergent composition" are intended washing products for washing machines, washing products for dishwashers, or any other washing product for domestic use.

By "washing bath" or "washing medium" is intended the aqueous solution of washing product (detergent composition) present in the washing machine during the wash cycles. The amount of washing product present is that recommended by the manufacturer; it is generally less than 20 g/liters. The Ph of such a solution is greater than 9.

Unexpectedly, it has now been determined that the formulation of polycarboxylic polymers in the at least partial form of one of their water-insoluble inorganic salts made it possible to combine builder activity with an increased chemical stability.

The subject polycarboxylic polymers, thus, no longer exhibit a substantially hygroscopic character.

According to the present invention, a polycarboxylic polymer is considered, substantially non-hygroscopic if it can be stored effectively and prolongedly, namely, for at least one month at 40° C. within a washing powder. By "effective storage" is intended storage, at the end of which, the degradation, which is usually observed, is considerably reduced and consequently the builder activity is preserved.

These storage conditions, i.e., one month at 40° C., are considered in the soap manufacturing industry as the conditions typical for storage of a washing formulation on commercial shelves.

In general, the polycarboxylic polymer is any polymer exhibiting a structural lability due, for example, to the presence, in the principal or backbone chain, of at least one hydrolyzable functional group.

Exemplary substantially non-hygroscopic polycarboxylic polymers according to the invention include derivatives of peptide polymers, polyesters of carboxylic acids, polyethers of carboxylic acids, polyamines of carboxylic acids, polycarbamates and/or of oxidized sugars or polysaccharides.

In a preferred embodiment of the invention, derivatives of peptide polymers are used.

Exemplary peptide polymers include the polymers or copolymers of amino acids of the aspartic or glutamic acid type.

Particularly preferred are derivatives of aspartic polyacids, glutamic polyacids and aspartic acid/glutamic acid copolymers in any proportions.

Such polypeptide polymers advantageously have a weight-average molecular weight on the order of 2,000 to $10^7$ and generally on the order of 3,500 to 60,000.

The aspartic and glutamic polymers and the aspartic acid/glutamic acid copolymers are commercially available. They can, for example, also be prepared according to the processes described in *J.A.C.S.*, 75, 6530 (1953); *J.A.C.S.*, 80, 3361 (1958); *J. Med. Chem.*, 16, 893 (1973); Polymer, 23, 1237 (1982).

These polycarboxylic polymers are present in the detergent compositions at least partially in the form of one of their water-insoluble inorganic salts or of a mixed salt, water-soluble salt/water-insoluble salt.

The water-insoluble inorganic salt is preferably the calcium or magnesium salt.

It is more preferably the calcium salt.

The preferred substantially non-hygroscopic polycarboxylic polymer is calcium polyaspartate.

In one particular embodiment of the invention, the polycarboxylic polymer may be only partly in the form of one of its water-insoluble salts, provided of course that the requisite non-hygroscopicity is maintained.

This comprehends that some carboxylic functional groups may, where appropriate, remain present in the structure of the carboxylic polymer either in their acidic form or in a form salified with a water-soluble salt. In this latter instance, a mixed salt is used. Exemplary water-soluble salts are those of sodium, potassium and ammonium. It is, especially, the couple Ca/Na.

The preferred water-soluble salts are those of sodium, potassium and ammonium.

One skilled in this art can readily determine either the proportion of acid functional groups to be salified according to the invention, or the water-insoluble inorganic salt/water-soluble salt molar ratio to be provided, in order to attain the requisite non-hygroscopicity.

As the mixed salt, the Na/Ca couple is preferably employed.

Such non-hygroscopicity may also be provided by a specific steric arrangement of carboxylic polymers.

The present invention also features formulations in which the corresponding, namely, substantially non-hygroscopic, polycarboxylic polymer, is provided in the form of granules, the external surface area of which is at least one substantially non-hygroscopic polycarboxylic polymer and the core of which is at least one water-soluble polycarboxylic polymer of identical or different chemical nature. By "water-insoluble polycarboxylic polymer" is intended a polymer whose acidic functional groups, or a fraction of whose acidic functional groups, are salified in the form of a water-insoluble inorganic salt and in a proportion such that the corresponding carboxylic polymer is rendered substantially non-hygroscopic and, therefore, stable in detergent powders. This non-hygroscopic polycarboxylic polymer capsule is not degraded within the detergent powder and preserves the core which comprises a polycarboxylic polymer in a water-soluble, i.e., acidic or water-soluble salt, form.

The amount of biodegradable and substantially non-hygroscopic polycarboxylic polymer comprising the detergent compositions of the invention may vary widely as a function of its intended activity in the washing formulation. This amount advantageously ranges from 0.2% to 80% by weight of the detergent composition. In the particular case where the polycarboxylic polymer according to the invention is employed as a co-builder, this amount preferably ranges from 2% to 15% of the weight of the detergent composition.

In addition to the biopolymer described above, at least one surfactant is present in the detergent composition in an amount which advantageously ranges from 2% to 50%, preferably from 6% to 30% of the weight of the detergent composition.

Exemplary surfactants formulated into the detergent compositions of the invention include:

(a) anionic surfactants of the types comprising soaps and alkali metals (alkali metal salts of $C_8$–$C_{24}$ fatty acids), alkali metal sulfonates ($C_8$–$C_{13}$ alkylbenzenesulfonates, $C_{12}$–$C_{16}$ alkylsulfonates, sulfated $C_6$–$C_{16}$ fatty alcohols, sulfated $C_8$–$C_{13}$ alkylphenols), alkali metal sulfosuccinates ($C_{12}$–$C_{16}$ alkylsulfosuccinates), and the like;

(b) nonionic surfactants of the types comprising polyoxyethylenated $C_6$–$C_{12}$ alkylphenols, oxyethylenated $C_8$–$C_{22}$ aliphatic alcohols, ethylene oxide/propylene oxide block copolymers, optionally polyoxyethylenated carboxylic acid amides;

(c) amphoteric surfactants of the alkyldimethylbetaine type;

(d) cationic surfactants of the alkyltrimethylammonium or alkyldimethylammonium chloride or bromide types.

Various additives and adjuvants may also be formulated into the detergent compositions of the invention to provide washing products or cleaning products in powder form.

Thus, the following exemplary additives and adjuvants may be formulated into the detergent compositions described above:

(1) detergent builders of the types comprising:

(i) phosphates in an amount of less than 25% of the total weight of the composition, (ii) zeolites in an amount of up to about 40% of the total weight of the composition, (iii) sodium carbonate in an amount of up to about 80% of the total weight of the composition, (iv) nitriloacetic acid in an amount of up to about 10% of the total weight of the composition, (v) citric acid, tartaric acid in an amount of up to about 20% of the total weight of the composition, the total amount of builder corresponding to about 0.2% to 80%, preferably from 20% to 45% of the total weight of said detergent composition;

(2) corrosion inhibitors such as silicates in an amount of up to about 25% of the total weight of the detergent composition;

(3) bleaching agents of the perborate, chloroisocyanate or N,N,N',N'-tetraacetylethylenediamine (TAED) types in an amount of up to about 30% of the total weight of the detergent composition;

(4) antiredeposition agents of the carboxymethylcellulose or methylcellulose types in amounts which may range up to about 5% of the total weight of the detergent composition;

(5) anti-incrustation agents of the acrylic acid and maleic anhydride copolymer types in an amount which may range up to about 10% of the total weight of the detergent composition;

(6) fillers of the sodium sulfate type in an amount which may range up to 50% of the total weight of the detergent composition.

The detergent compositions according to the present invention exhibit good efficacy both in primary detergency and in secondary detergency. In addition, the incorporation of a polycarboxylic polymer in a form as described above, namely, which is water-soluble only within a washing medium, assures that the detergent composition has a storage stability which is clearly greater than that of a composition directly containing the biodegradable polypeptide in the conventional water-soluble form.

The present invention also features the use of the compositions described above.

In order to further illustrate the present invention and the advantages thereof, the following specific examples are given, it being understood that same are intended only as illustrative and in nowise limitative.

EXAMPLE 1

Formulation of a detergent composition for washing machines from calcium polyaspartate:

The following solid detergent composition was formulated by dry mixing the various additives set forth below:

| COMPOSITION OF THE WASHING PRODUCT | % BY WEIGHT |
|---|---|
| Linear alkylbenzenesulfonate | 7.5 |
| CEMUSOL LA 90 ® (polyoxyethylenated lauric acid marketed by S.F.O.S.) | 4 |
| Zeolite 4 A | 24 |
| Na silicate ($SIO_2/Na_2O$-2) | 1.5 |
| Na carbonate | 10 |
| TAED | 2 |
| Na perborate | 15 |
| Ethylenediaminetetraacetic | 0.1 |
| Calcium polyaspartate | 3 |
| Tiponal DMX ® | 0.1 |
| Tiponal SOP ® (optical brighteners marketed by CIBA-GEIGY) | 0.1 |
| Silicone antifoam | 0.2 |
| Alcalase | 0.15 |
| Savinase (enzymes) | 0.15 |
| Na sulfate | qs 100% |

A "control washing product" was formulated from the above composition for purposes of comparison, but containing sodium polyaspartate instead of calcium polyaspartate.

Each of these formulations was stored for one month at 40° C.

EXAMPLE 2

Secondary detergency performance of the washing product for washing machines of Example 1:

After a prolonged storage, the secondary detergency activity and more particularly the "incrustation" effect of the precipitates which may form on the fabrics during washing was determined for the washing product of Example 1 and the control washing product.

This effect was measured after 20 washes carried out in the presence of the following test pieces of fabric:

(a) Testfabric 405 cotton textiles (1)

(b) Krefeld 12A cotton (2)

The inorganic incrustation was calculated from the ash content (in % relative to the total weight of the cotton) of the fabrics washed, dried and burned at 950° C. for 3 hours.

The incrustation-inhibiting effect was evaluated by the ratio ash content with additives/ash content without additives, reported under the letter T in the Table I:

TABLE

| Fabric | T Control washing product | T Washing product of Example 1 | T Washing product without polymer |
|---|---|---|---|
| (1) | 100% | 75% | 100% |
| (2) | 100% | 60% | 100% |

It will be seen that only the washing product based on calcium polyaspartate exhibited an anti-incrusting activity after 1 month of storage.

EXAMPLE 3

This example was designed to measure the biodegradability of calcium polyaspartate. The corresponding "ultimate" biodegradability was measured according to the AFNOR T90-312 standard (in conformity with international standard ISO 7827).

The test was carried out beginning with:

(i) an inoculum obtained by filtering water entering the urban treatment plant of Saint Germain au Mont d'Or (Rhône);

(ii) a test medium containing $4\times10^7$ bacteria/ml;

(iii) a quantity or product to be tested such that the test medium contained an organic carbon concentration on the order of 40 mg/l.

The rate of biodegradability of the product tested as a function of time was on the order of 60% in 20 days under the conditions for discharge into river water.

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims, including equivalents thereof.

What is claimed is:

1. A solid, particulate detergent composition which comprises a detergency surfactant and a builder therefor, said builder comprising at least one storage-stable, substantially non-hygroscopic, at least partially water-insoluble biodegradable polycarboxylic polymer compatible therewith, wherein said polycarboxylic polymer is a calcium salt of aspartic or glutamic acid polymer or copolymer, wherein said calcium salt ranges from about 2% to about 3% by weight of the entire composition.

2. The detergent composition as defined by claim 1, said at least one polycarboxylic polymer comprising calcium polyaspartate.

3. The detergent composition as defined by claim 1, said detergency surfactant comprising from 2% to 50% by weight thereof.

4. The detergent composition as defined by claim 1, having a storage stability of at least one month at 40° C.

5. The detergent composition as defined by claim 1, comprising granular particulates thereof.

6. The detergent composition as defined by claim 1, further comprising (1) a phosphate, zeolite, sodium carbonate, nitriloacetic acid, citric acid or tartaric acid co-builder, (2) a corrosion inhibitor, (3) a bleaching agent, (4) an anti-redeposition agent, (5) an anti-incrustation agent or (6) an inorganic filler material or mixtures thereof.

7. A washing bath/medium comprising an aqueous solution of the detergent composition as defined by claim 1.

8. In a process for the washing of a soiled article with a detergent composition in a washing bath/medium, the improvement which comprises, as the washing bath/medium therefor, the washing bath/medium as defined by claim 7.

* * * * *